US007222860B2

(12) United States Patent
Box et al.

(10) Patent No.: US 7,222,860 B2
(45) Date of Patent: May 29, 2007

(54) ARCHERY TARGET

(76) Inventors: Joe Box, 10380 N. Pond La., Twinsburg, OH (US) 44087; Michael James Galloway, 13030 Vista Pointe, Chardon, OH (US) 44024

( * ) Notice: Subject to any disclaimer, the term of this patent is extended or adjusted under 35 U.S.C. 154(b) by 0 days.

(21) Appl. No.: 11/298,409

(22) Filed: Dec. 9, 2005

(65) Prior Publication Data

US 2006/0157938 A1 Jul. 20, 2006

Related U.S. Application Data

(60) Provisional application No. 60/634,938, filed on Dec. 10, 2004.

(51) Int. Cl.
*F41J 3/00* (2006.01)

(52) U.S. Cl. ..... 273/403; 273/408

(58) Field of Classification Search ..... 273/403, 273/404, 407, 408

See application file for complete search history.

(56) References Cited

U.S. PATENT DOCUMENTS

| | | | | |
|---|---|---|---|---|
| 3,088,738 | A | 5/1963 | Meyer | |
| 4,076,246 | A | 2/1978 | Meyer | |
| 4,126,501 | A | 11/1978 | Croll | |
| 4,244,585 | A | 1/1981 | Cross | |
| 4,813,684 | A * | 3/1989 | Bruno | 273/403 |
| 4,940,244 | A | 7/1990 | Batts, III | |
| 5,465,977 | A | 11/1995 | Mann | |
| 5,865,440 | A | 2/1999 | Pulkrabek | |
| 6,799,764 | B2 | 10/2004 | Ingold | |
| 6,926,281 | B1 * | 8/2005 | Woock | 273/403 |
| 7,070,185 | B2 * | 7/2006 | Pulkrabek | 273/408 |
| 2004/0140623 | A1 * | 7/2004 | Pulkrabek | 273/408 |

* cited by examiner

*Primary Examiner*—Mark S. Graham
(74) *Attorney, Agent, or Firm*—Fay Sharpe LLP

(57) ABSTRACT

An archery target having a first and a second elongated support plate extending parallel to one another between a respective first and second plate ends. Each of the support plate having a support-plate length, inner surfaces facing one another and outer surfaces opposed to the inner surfaces. Each plate further including a strap opening. The target further including a plurality of elongated foam sheets extending parallel to one another to form a foam laminate having side surfaces parallel to the sheets and end surfaces transverse to the sheets. The side surfaces each facing one of the inner surfaces of the support plates and defining a foam laminate length that is shorter than the support-plate length. The foam laminate further including a front surface extending between the plates having an arrow receiving zone. The target including at least one compression strap extending about the outer surfaces of the plates and through the strap openings such that the strap is spaced from the first and second ends of the plates wherein the strap urges the support plates toward the foam laminate and maintains the support plates relative to the foam laminate.

23 Claims, 8 Drawing Sheets

ARCHERY TARGET

This application claims priority on U.S. provisional application Ser. No. 60/634,938, filed Dec. 10, 2004, entitled "ARCHERY TARGET."

FIELD OF THE INVENTION

The invention of this application relates to targets, and more particularly, to an improved archery target.

INCORPORATION BY REFERENCE

The invention of this application relates to targets that can be used in archery. Meyer U.S. Pat. No. 3,088,738 discloses an archery target and is hereby incorporated by reference for showing the same. Croll U.S. Pat. Nos. 4,126,501 and 4,244,585 disclose an archery target that includes a plurality of layers formed by winding a strip of material about a central axis and the method of making the same and is also incorporated by reference herein for showing the same. Meyer U.S. Pat. No. 4,076,246 discloses an archery target that utilizes multiple plies of penetrable, elastomeric or resilient, tear resistant sheet resin material and is also incorporated by reference herein for showing the same. Batts, III U.S. Pat. No. 4,940,244 discloses an archery target that also includes a plurality of layers wherein the layers are vertical layers and the end supports extend beyond the vertical layers to produce legs to support the target and is incorporated by reference herein for showing the same. Mann U.S. Pat. No. 5,465,977 discloses an archery target with horizontal layers and is incorporated by reference herein for showing the same. Pulkrabek U.S. Pat. No. 5,865,440 discloses an archery target that includes horizontal layers and end supports shorter than the layers and is incorporated by reference herein for showing the same. Ingold U.S. Pat. No. 6,799,764 also discloses an archery target that includes horizontal layers, however, Ingold discloses end supports that are even with the horizontal layers and is incorporated by reference herein for showing the same.

BACKGROUND OF THE INVENTION

As is known, a wide variety of materials can be used as an archery target. However, the chosen material must allow the arrow to enter the target but not fully penetrate the target. Essentially, the target must stop the arrow without damaging the arrow while presenting the user with a mark or other visual element to aim toward and gauge one's aim. In this respect, archery arrows are reusable and, therefore, it is advantageous that arrows shot into the targets are not damaged.

Over the years, natural products, such as hay or straw, have been used as archery targets. This includes use of hay or straw as the portion of the target that stops the arrow. A printed target can be placed over the straw to produce the mark or other visual target for aiming. While these natural materials can be used to stop arrows, exposure to the environment will quickly deteriorate and weaken the natural material, and arrows can be difficult to remove from this type of material. Further, the penetration by the arrow quickly breaks down the structure of the material reducing the stopping characteristics of the natural material. As can be appreciated, an arrow that substantially penetrates the stopping material can be difficult to remove and may need to be removed from the backside of the target.

In order to overcome the problems with natural materials, manmade materials have been used to replace the natural material discussed above. The manmade material can be weather resistant and can effectively stop the arrow. However, prior art targets utilizing manmade materials also breakdown too quickly and can damage the arrow. Layered materials have been found to fray on the edges and allow moisture to penetrate the layers. This results in trapped moisture within the target that can reduce the effectiveness of the target and which causes the arrows to be exposed to excessive moisture. As can be appreciated, a wet arrow must be dried before it is shot a second time.

Another problem with prior art targets is heightened probability of damaging the arrow and/or the heightened probability of target failure. In this respect, no mater what material is used, the material must form a stable target area. Natural materials, such as hay bails, utilize twine as a binder to hold the hay or straw together. Manmade materials still need a binder to hold the layers together. Further, the binder should be configured in a way that it does not damage the arrow. As a result, there are tradeoffs between binders with superior structural characteristics and binders that will yield to an arrow so that the arrow is not damaged if the arrow strikes the binder. Prior art targets have not achieved the optimal balance between structural characteristics and minimal arrow damage.

Even yet another problem with prior art targets is stability. In this respect, an arrow traveling at high speeds has a significant amount of momentum. This momentum impacts that target when the arrow strikes the target. The target must be capable of remaining substantially stationary upon impact, or the user must realign the target if the target moves and/or tips over. While a lightweight target may be easier to move, it can easily tip over and can rotate upon impact by the arrow.

SUMMARY OF THE INVENTION

The present invention is applicable generally to targets, and more particularly to archery targets that are durable, stable, easy to use and can stop an arrow with minimal damage to the arrow. More particularly, the archery target according to the invention of this application includes a plurality of layers of sheet material positioned between at least one support plate that extends beyond the sheet material to create added stability.

In this respect, an archery target according to an aspect of the present invention includes an elongated support plate extending between a first and second ends and having a support-plate length, an inner surface and an outer surfaces opposed to the inner surfaces. Further, the support plate includes at least one strap opening. The archery target further includes a plurality of elongated foam sheets extending parallel to one another and parallel to the support plate to form a foam laminate having side surfaces parallel to the sheets and end surfaces transverse to the sheets. One of the side surfaces facing the inner surfaces of the support plate and defining a foam laminate length that is shorter than the support-plate length. The foam laminate further includes a front surface extending from the support plate having an arrow receiving zone. The target further including at least one compression strap extending about the outer surface of the support plate and through the strap openings such that the strap is spaced from the first and second ends of the plate wherein the strap urges the support plate toward the foam laminate and maintains the support plate relative to the foam laminate.

In accordance with another aspect of the present invention, the archery target can be wrapped and sealed by an outer plastic layer. In one embodiment, the plastic layer is a plastic corrugated material that can provide support for the target components.

In accordance with yet another aspect of the present invention, the target can include multiple compression bands.

In accordance with a further aspect of the present invention, the support plates can include openings spaced from one another to allow the compression band(s) to tightly extend around the foam laminate while allowing the support plates to extend beyond the foam laminate or sheet layers.

In accordance with even yet a further aspect of the present invention, the foam sheets are made from closed cell foam.

In accordance with yet another aspect of the present invention, the archery target further includes a first and a second transverse sheet layer extending transverse to the foam sheets extending along the end surfaces of the foam laminate.

These and other aspects of the invention will be apparent to those skilled in the art in view of the following discussion and the appended claims.

BRIEF DESCRIPTION OF THE DRAWINGS

The foregoing and more will in part be obvious and in part be pointed out more fully hereinafter in connection with a written description of preferred embodiments of the present invention illustrated in the accompanying drawings in which.

DETAILED DESCRIPTION OF THE PREFERRED EMBODIMENTS

Figure 1:
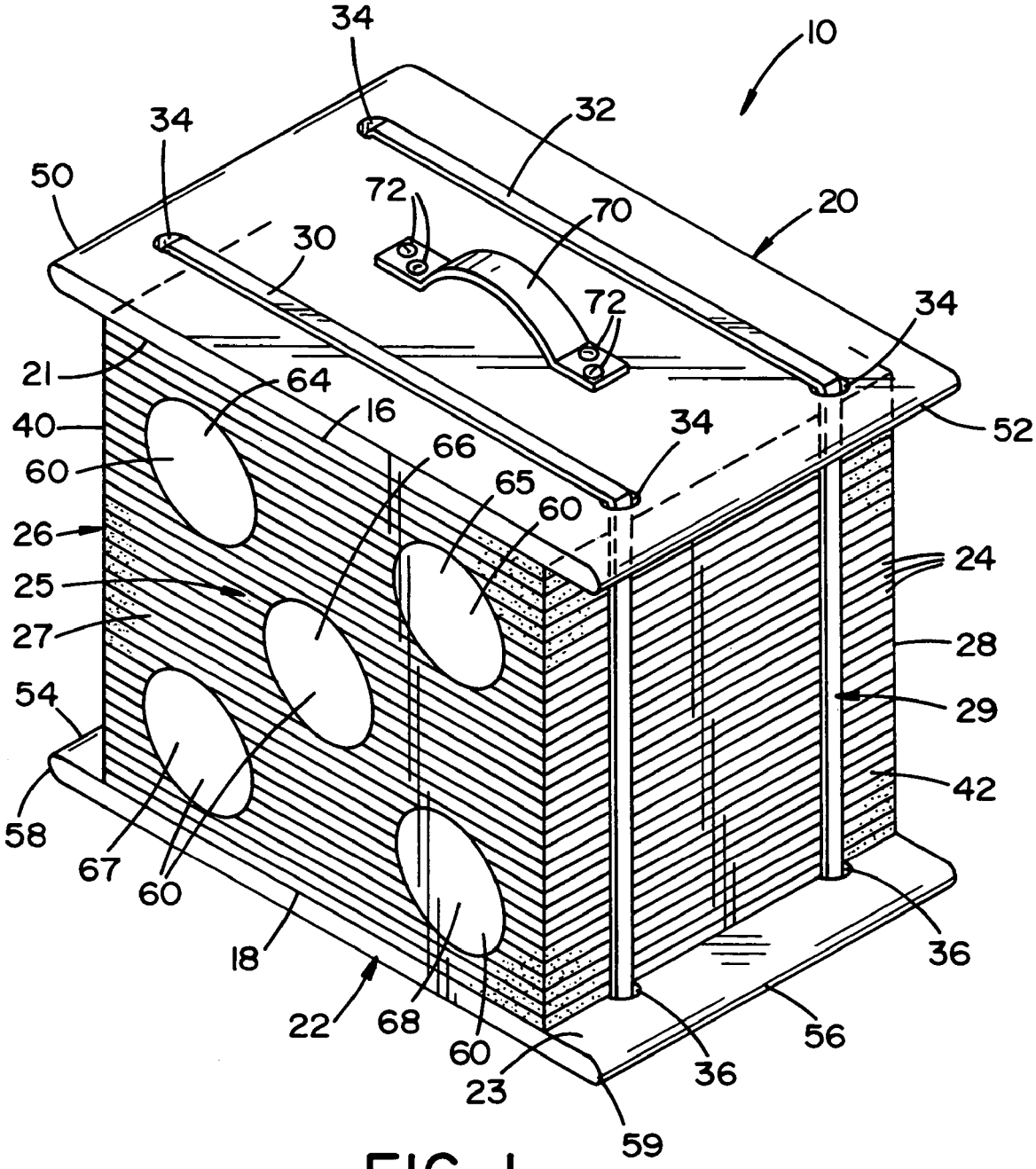
FIG. 1 is a perspective view of an archery target according to one aspect of the invention.
Figure 2:
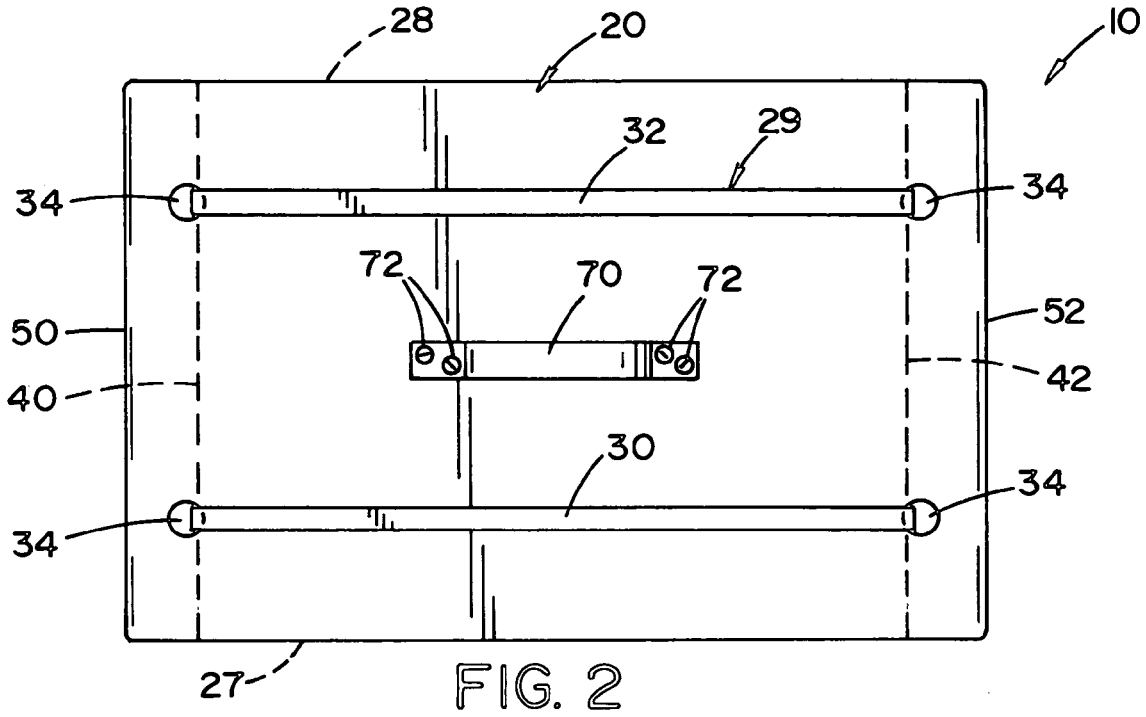
FIG. 2 is a top view of the target shown in FIG. 1.
Figure 3:
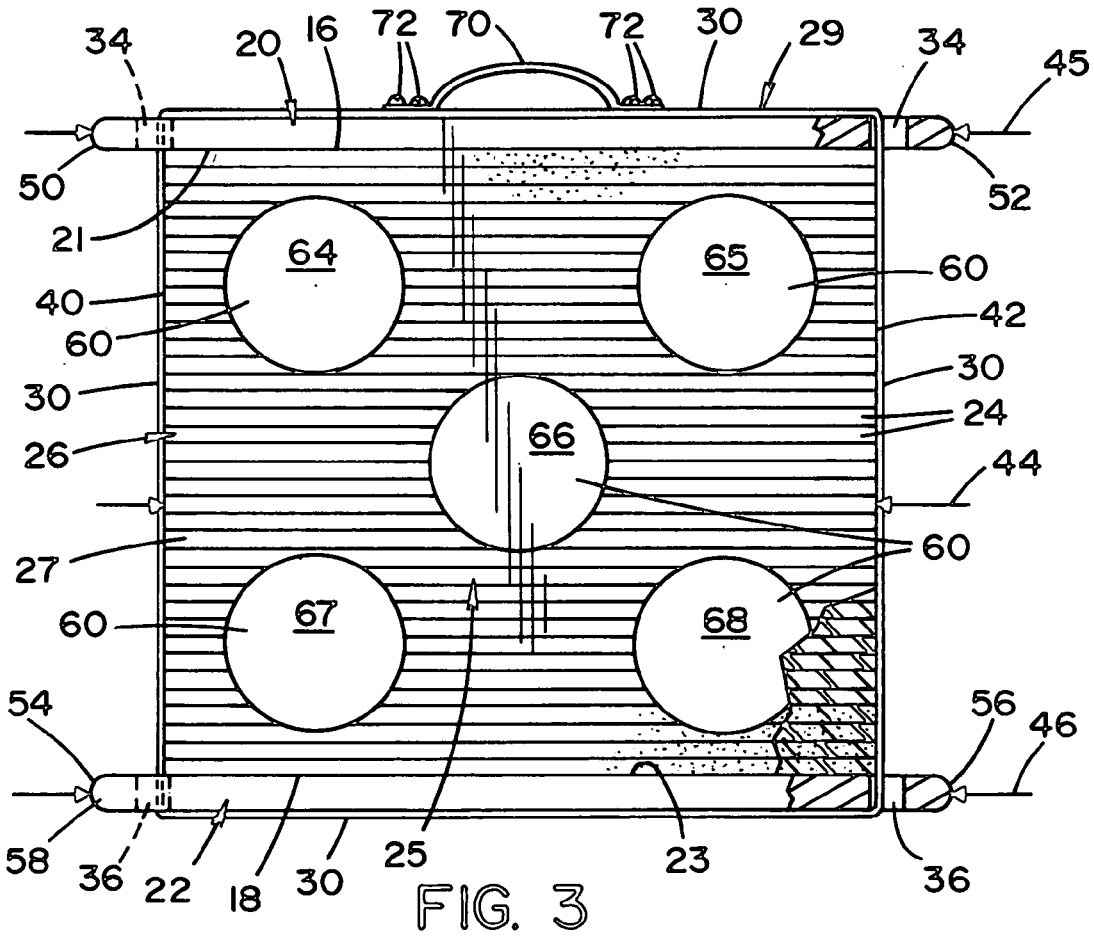
FIG. 3 is a front elevational view of the target shown in FIG. 1.

Referring now in greater detail to the drawings wherein the showings are for the purpose of illustrating preferred embodiments of the invention only, and not for the purpose of limiting the invention, FIGS. 1-3 illustrate an archery target 10 having a support plate 20 with a bottom surface 21 and bottom support plate 22 with a top surface 23 generally facing bottom surface 21. Target 10 further includes an elongated foam sheet layers 24 positioned between the surfaces 21 and 23 of the support plates. Support plates 20 and 22 can be made from any rigid material including, but not limited to, wood, steel, plastic or any other material now known in the art or produced in the future. For example only, support plates 20 and 22 can be wooden support plates that are approximately ½ inch thick. However, as can be appreciated, other materials that have different material properties can have different thicknesses while being rigid.

In this embodiment, the plates are configured such that deflection of the support plate is minimized to produce plates that are substantially flat and parallel to one another. This configuration creates a good base structure for maintaining the target in a desired position on a ground surface.

Several layers 24 together form a foam laminate 26 which is the portion of the target that will stop and retain an arrow (not shown) shot from a wide range of bows. The foam laminate can have a range of configurations without detracting from the invention of this application. In this respect, any foam known in the art can be utilized; however, closed cell foam has been found to produce a superior target laminate. As is stated above, foam laminate 26 includes a plurality of parallel foam sheets 24. Further, laminate 26 has a front surface 27 and a rear surface 28 that can both include an arrow receiving zone 25. Laminate 26 further includes a top surface 16 and a bottom surface 18.

The arrow receiving zone can have target indicia printed directly on the foam layers or can have an outer layer which includes the printed indicia, which will be discussed in greater detail below. The printed indicia can be any printed material known in the art such as circles, dots, wildlife etc. Further, the target can be used with separate printed targets such as paper targets affixed to one or both of the foam surfaces. In one embodiment, the target can include a fastener system, such as a VELCRO brand fastener system, which will be discussed in greater detail below, to support separate and replaceable targets known in the art, such as paper targets.

Support plates 20 and 22 are secured relative to one another with a binder 29 to hold the target together. Binder 29 can also be used to create compressive forces on layers 24. In one embodiment, the binder includes compression straps which can be any known compression strap system known in the art such as bands 30 and 32. Support plate 20 includes openings 34 and support plate 22 includes openings 36 to allow bands 30 and 32 to pass therethrough and to allow the boards to extend beyond side edges 40 and 42 of foam laminate 26. In this respect, foam laminate 26 has a length 44 extending between side edges 40 and 42, support plate 20 has a length 45 extending between side edges 50 and 52, and support plate 22 has a length 46 extending between side edges 54 and 56. Lengths 45 and 46 of support plates 20 and 22, respectively, are greater than length 44 of laminate 26. While lengths 45 and 46 are shown to be substantially equal, this is not a requirement for the invention of this application.

This support plate configuration creates a more stable target. In this respect, by extending the boards beyond laminate 26, target 10 has a larger base structure, which reduces the tendency of the target to tip. In addition, corners 58 and 59 can be solid, right angle corners that enhance target stability. Prior art targets tended to have large-radius rounded corner sections to allow the binder to flow from the bottom surface to the side surface. This prior art configuration creates targets that are unstable side-to-side. By spacing the binder from edges 50, 52, 54 and 56, corners 58 and 59 are not affected by the binder and can be configured for stability wherein the rounded flow or transition between bottom surface and side surface can be internal. However, as will be discussed below, corners 58 and 59 can have "softened" edges or other stylized edges, since they are spaced from the binder.

Another advantage is that binder 29 creates less distortion in the target base by utilizing the holes to allow for the bending of the binder from the base surface to the side surface. This allows the binder to be very tight without distorting the support plates and has other advantages, such as spacing binder 29 from zone 25, that will be discussed in greater detail below.

In addition, support plates can have a width or depth, transverse to the length, that is greater than the width of layers 24, which can further increase the stability of the target. Outer edges 50, 52, 54 and/or 52 can also include edge configurations, such as a rounded edge, to "soften" the edge. As can be appreciated, the edge configuration can include rounded edges as are shown and can include non-linear edges from front to back. Again, support plates 20 and 22 can be identical in configuration, can be mirror images of each other and/or can have different configurations without detracting from the invention of this application. This can include, but is not limited to, bottom support plate 22 being larger than top plate 20.

Layers 24 are parallel elongated sheet like-layers that can be stacked on one another to form laminate 26. Layers 24 can be any type of material known in the industry that will stop the flight of an arrow shot into laminate 26. It has been found that closed-cell foam layers are preferred. Section 26 can include one or more target indicia 60 front surface 27 and/or rear surface 28. As is stated above, this can include any known target indicia such as, for example, target dots 64-68.

As is stated above, bands 30 and 32 maintain support plates 20 and 22 relative to one another and relative to layers 24. Further, bands 30 and 32 can also be utilized to compress the layers to increase the frictional stopping power of the layers when the arrow enters the target. Bands 30 and 32 can be any known bands including, but not limited to, steel packing bands and/or plastic packing bands.

Target 10 can further include other features for convenience and stability such as a carrying case, not shown, or a handle 70 that can be secured to top plate 20. Handle 70 can be secured to the top plate by any method known in the art including fasteners 72. Other such features will be discussed below in connection with other embodiments of the invention of this application.

In the following discussions concerning other embodiments of the invention of this application, like features will include like reference numbers as described above for convenience only. However, it should be understood that the use of like reference numbers should not be construed to require the items to be included and/or to be identical. As with all embodiments, modifications can be made and equivalences can be utilized without detracting from the embodiment and/or from the invention of this application.

Figure 4:
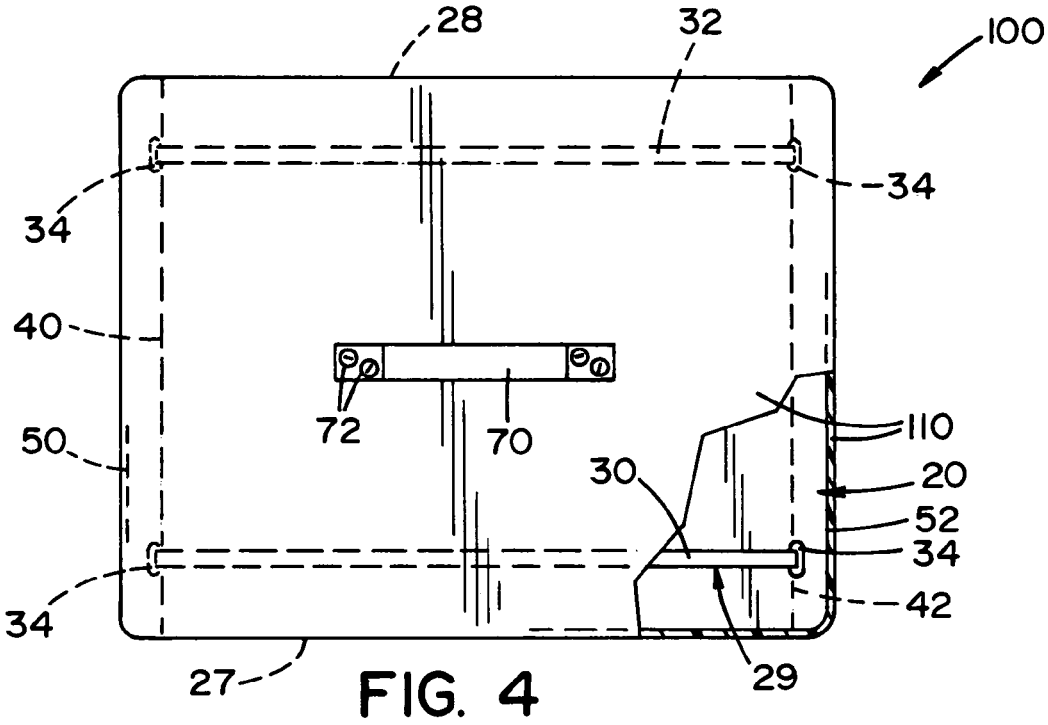
FIG. 4 is a top view of another embodiment of a target according to another aspect of the present invention.
Figure 5:
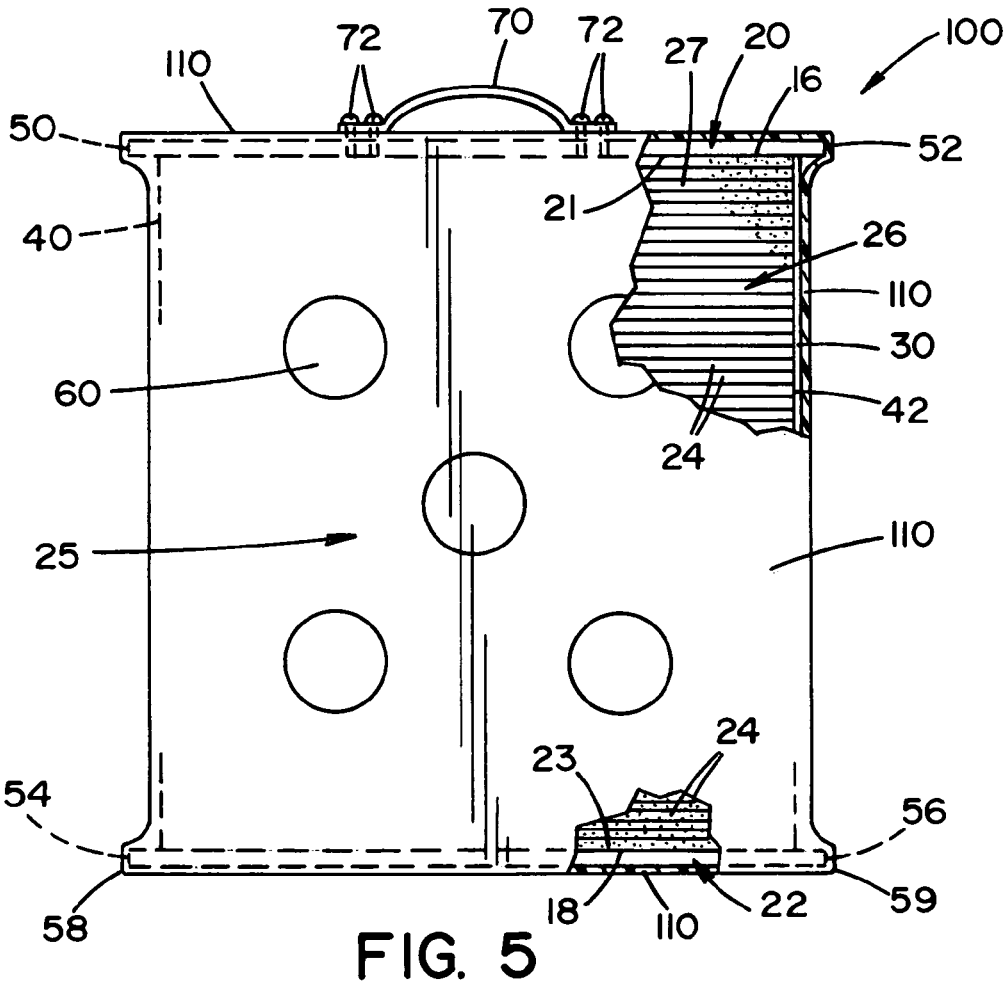
FIG. 5 is a front elevational view of the target shown in FIG. 4.

With reference to FIGS. 4 and 5, target 100 is shown. In this embodiment, the target further includes an outer layer 110. Layer 110 can be made from a wide range of material including a plastic layer such as a plastic shrink wrap. As can be appreciated, layer 110 can be any desired color and can include target indicia 60 printed thereon. As will be discussed in greater detail below, layer 110 can be used for structural reasons along with for visual reasons. For example, layer 110 can be used to reduce unwanted moisture from absorbing into layers 24.

Figure 6:
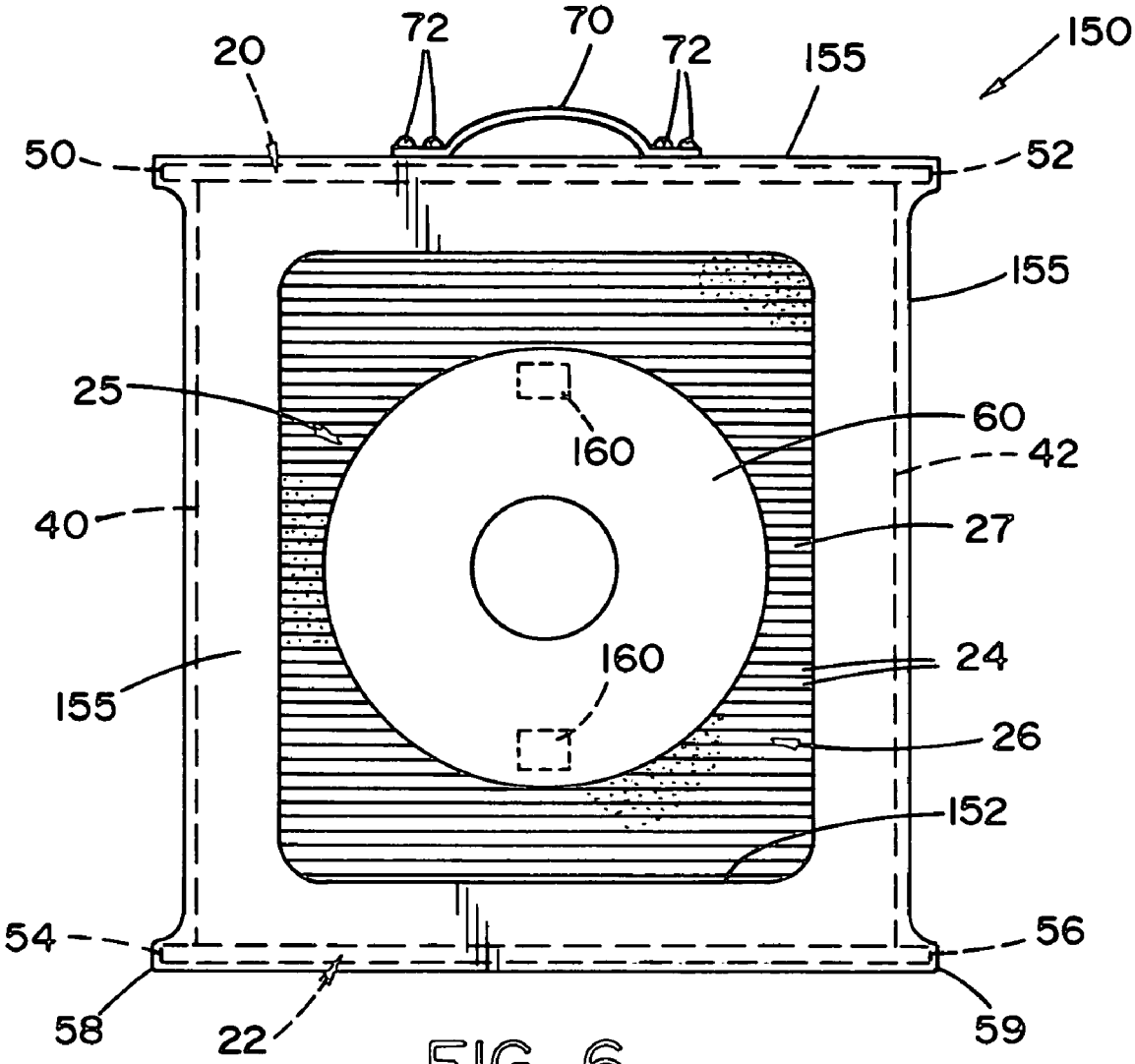
FIG. 6 is a front elevational view of the archery target shown in FIG. 4 with different target indicia.

With reference to FIG. 6, target 150 is shown. Target 150 includes an outer layer 155 that includes an opening such as an opening 152 that exposes front surface 27 of layers 24. In this embodiment, indicia 60 is on surface 27. In yet another embodiment, indicia 60 can be secured to the surface by a fastener 160. Fastener 160 can be any fastening system known in the art including, but not limited to, tape and/or VELCRO brand hook and loop fasteners. In addition, fastener 160 can include a push fastener designed to penetrate laminate 26 between adjacent layers and be supported by the frictional engagement of the adjacent layers. However, as can be appreciated, fastener 160 should be made from a material that will not damage an arrow if hit by the arrow. This can include, for example, a low strength plastic and/or a fabric material.

Figure 7:
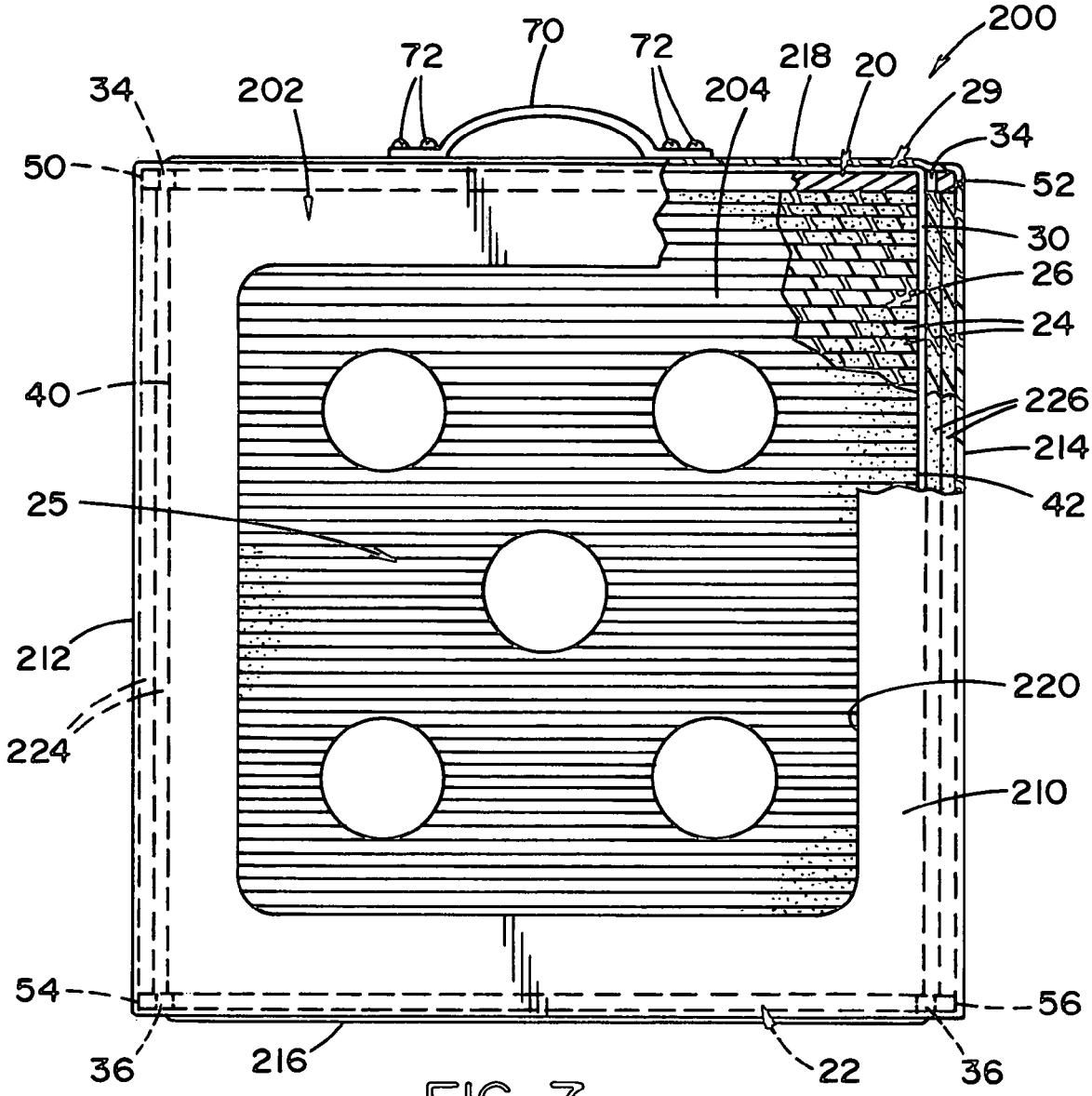
FIG. 7 is a front elevational view of yet another embodiment of the present invention.
Figure 8:
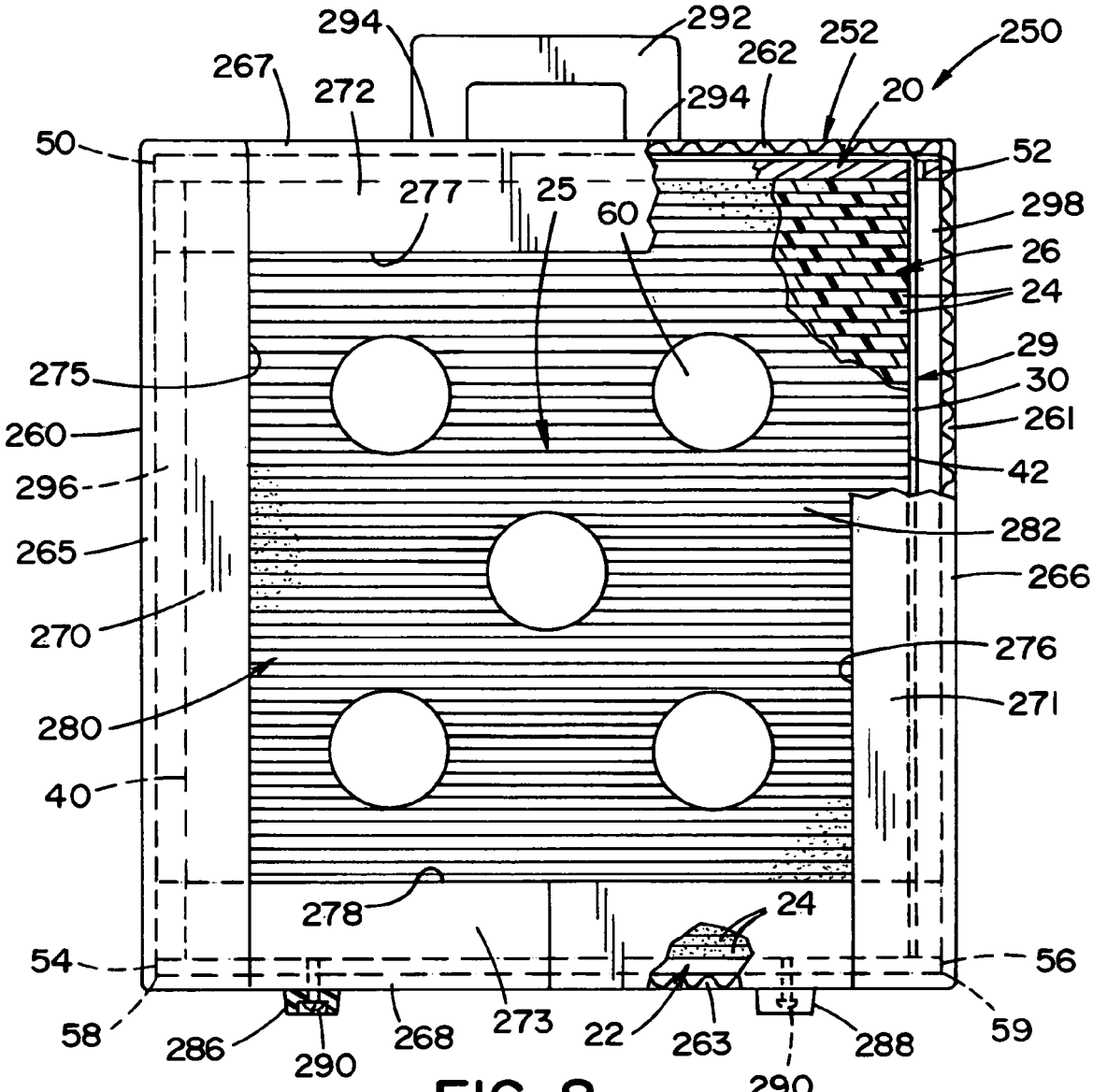
FIG. 8 is a front elevational view of even yet another embodiment of the present invention.
Figure 9:
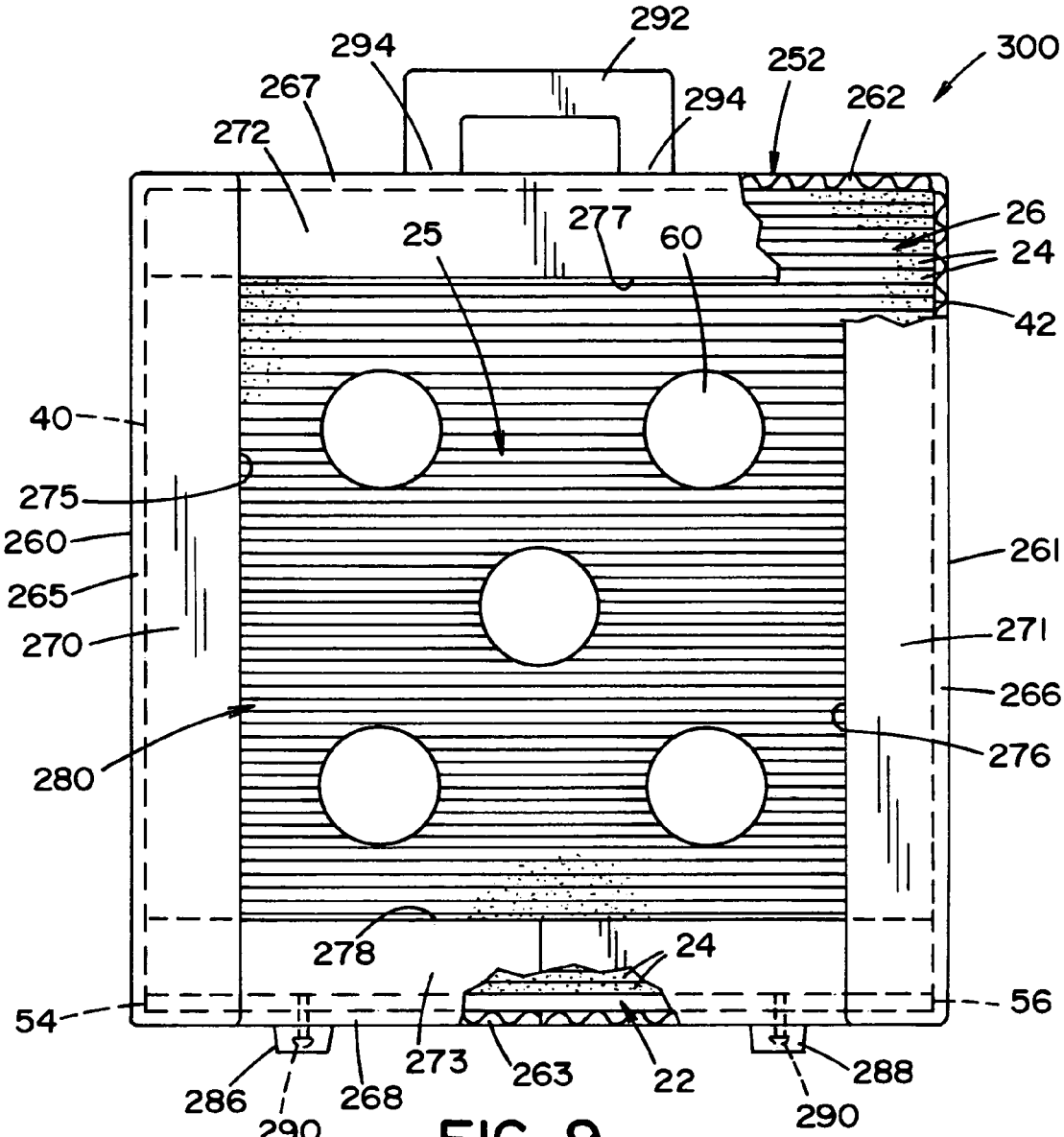
FIG. 9 is a front elevational view of a further embodiment of the present invention; and, FIG. 10 is a front elevational view of even yet a further embodiment of the present invention.

With reference to FIGS. 7-9 shown are targets 200, 250 and 300, respectively, that include an outer layer made from a plastic corrugated material along with differing internal structures. In this respect, target 200 includes an outer layer 202 which is a sheet material folded about the target. Layer 202 can have any construction known in the art, including structures known in the packaging art for folding sheet material. As is stated above, this material can be a plastic corrugated material and, further, the material can provide structure to the target. In one embodiment, layer 202 includes a one-piece front panel 210, side panels 212 and 214, bottom panel 216 and top panel 218. Layer 202 can also include a back panel (not shown) that is the same as front panel 210, or a back panel with a unique configuration. Front panel 210 includes a front opening 220 that surrounds arrow receiving zone 25. Target 200 can further include a second outer layer 204 within outer layer 202. The second outer layer can be utilized as a vapor barrier to minimize water absorption by the target and/or can have other functions such as a printable surface for target indicia 60. Further, layer 204 can be a partial outer layer and/or a replaceable outer layer. In this respect, layer 204 can be configured to only cover opening 220 in the front and/or back surfaces. In another embodiment, layer 204 can be removable and replaceable to allow easy replacement of target indicia or even target customization.

Target 200 can further include vertical layers 224 and 226. One or more vertical sheets can be used to fill the gap between side surface 40 and 42 and side panels 212 and 214, respectively. As is stated above, spacing binder 29 from edges 50, 52, 54 and 56 creates a more stable based structure. However, it creates a void between the side panels and the side edges of the laminate. Vertical sheets 224 and 226 can be used to fill these voids. Further, vertical sheets 224 and/or 226 can be single sheets or multiple sheets, depending on the desire result. Layers 224 and 226 can also be foam layers and can be formed by the same sheets used to create laminate 26. Layers 224 and 226 can also be closed cell foam layers to increase the moisture resistant nature of the target. In this respect, side edges 40 and 42 are the side edges of foam sheets 24 which are exposed and, therefore, produce points at which moisture can easily enter foam laminate 26, even if closed cell foam is used. By including vertical sheets 224 and 226, these exposure points can be effectively covered by a structure that can be struck by an arrow without being substantially damaged as would a thin plastic layer. Yet another advantage of layers 224 and 226, is that these layers help protect the compression strap from the elements and from damage during transporting the target or using the target. In this respect, binder 29 can be positioned between laminate edge 40 and layer 224 and positioned between laminate edge 42 and layer 226. This spaces the bands from the side edges of the target and provides cushioned protection.

Target 250 includes outer sheet layers 252 that can substantially cover the target for structural and/or visual purposes. More particularly, layer 252 includes side panels 260 and 261, top panel 262 and bottom panel 263. Panels 260-263 include front edges 265-268 and rear edges (not shown). As can be appreciated, the rear surface of target 250 or any other target of this application can be identical to the front surface, including the inclusion of target indicia. However, as can be appreciated, the rear surface can have different characteristics, such as different target indicia. Target 250 further includes front flaps 270-273 extending from edges 265-268, respectively. Flaps 270-273 have inwardly facing edges 275-278, respectively, which form a front target opening 280 to expose arrow receiving zone 25.

Target 250 can further include a second outer layer 282 within outer layer 252. The second outer layer can be utilized as a vapor barrier to minimize water absorption by the target and/or can have other functions such as a printable surface for target indicia 60. Further, layer 282 can be a partial outer layer and/or a replaceable outer layer. In this respect, layer 282 can be configured to only cover opening 280 in the front and/or back surfaces. In another embodiment, layer 282 can be removable and replaceable to allow easy replacement of target indicia or even target customization.

Target 250 can also include base feet 286 and 288 that can be secured to plate 22 by an method known in the art including, but not limited to, by fasteners 290 screwed into plate 22. Further, target 250 can include a handle 292. In one embodiment, handle 292 can be formed from outer layer 252. In this respect, handle 252 can be die cut directly from panel 262 wherein, the handle can pivot about a base edge 294 from a retracted position flush with panel 262 (not shown) to an operational position shown in FIG. 8. Target 250 further include s gaps 296 and 298 between side edges 40 and 42 and panels 260 and 261, respectively.

Arrows can be expensive and are designed to be reused. Thus, it is important to prevent the arrows from being damaged when they are shot. That is the basis for creating targets that are designed to stop the arrow, while allowing the user to see where the arrow was shot and while minimizing the damage to the arrow, so that the arrow can be used again. As a result, utilizing heavy gauge metal to secure the support plates to one another has been found to be counterproductive. Even if the rigid fasteners are spaced from the target zone, a significant chance of striking the supports still exists. As can be appreciated, an arrow that strikes one of these rigid fasteners will likely be damaged and could be damaged beyond repair. By utilizing an outer layer that partially supports the target structure, as opposed to merely a protective plastic layer, the fastener system used to maintain the plates relative to one another can be "softened" or eliminated, which drastically reduces the likelihood of damage to the arrow. In this context, "soften," includes plastic straps, fabric straps or cords and/or wide, thin plastic or material straps. In the event that "softened" strap is partially damaged or even significantly damaged, the corrugated outer layer of the targets described above can help support the target system.

In yet another embodiment, the straps can be several or even many straps that are designed to yield to the arrow, thereby preventing damage to the arrow; but since there are several straps, the target as a whole will not fail. This can be used by itself with a purely weather resistant outer coating, no coating or can be used in connection with a supporting outer coating such as an outer layer made from a corrugated plastic.

In yet even a further embodiment of the present invention, the outer layer can provide a good printing surface for logos, promotional materials, target and/or bull's-eyes. Further, the use of an outer wrap can allow the target to be easily made in virtually any color regardless of the materials chosen to produce the support plates and/or the foam layers. In addition, the outer wrap allows a single inner target structure, namely, support plates 20 and 22, layers 24 and binder 29 to be used to create a wide range of targets in a wide range of colors and/or target or bull's-eye configurations for a wide range of customers.

As can be appreciated, the targets including support plates 20 and 22 can be any one of a wide range of sizes without detracting from the invention of this application. Further, holes 36 in the support plates can be a wide range of sizes. As is best shown in FIGS. 2 and 4, holes 36 can be large holes that can make manufacturing easier or even small holes to minimize the structural change to the support plates. Further, the openings in the support plates do not need to be holes. In this respect, the support plates can include openings extending inwardly from the side edges of the support plates, which can be used to create the spacing of binder 29 from the side edges.

As is stated above, the outer layer can be made from corrugated plastic, and it can provide at least a portion of the frame or structure of the target. This structure can be a reinforcing layer that increases the structural integrity of the target and can be used to allow the use of "soft" strap system. In either case, the corrugated layer can maintain the target's structure in the event that the binder partially or fully fails. Further, by utilizing corrugated plastic, handle 292 can be die cut directly from the corrugated plastic, which simplifies the product and further reduces weight. As can be appreciated, other handles known in the art could also be used. The corrugated layer can be attached to the other components by any fastening system known in the art including, but not limited to, by staples securing the corrugated layer to the support plates.

In yet even a further embodiment of the present invention, the outer layers can be used to replace the straps or bands to maintain the support plates relative to the foam sheets. Or, in another embodiment, the corrugated layer can be used to reduce the number or structure strength of the straps to help the straps support the target structure.

With reference to FIG. 9, the outer layer can also be utilized to replace one of the support plates. In this respect, shown is target 300 that includes an outer layer 252. However, as is shown, the use of a structural outer layer can allow the removal of support plates 20, 22 and/or binders 29. More particularly, target 300 does not include binder 29 and does not include support plate 20. Target 300 utilizes outer layer 252 to maintain layers 24 relative to one another, and to maintain laminate 26 relative to support plate 22. Further, layer 252 can be used to compress sheets 24 as desired. While not shown, support plate 22 can also be removed with the use of a structural outer layer.

While the outer layers in the above embodiments are shown to be one-piece outer layers, that is not a requirement for the invention of this application. The outer layers can be multiple components.

Figure 10:
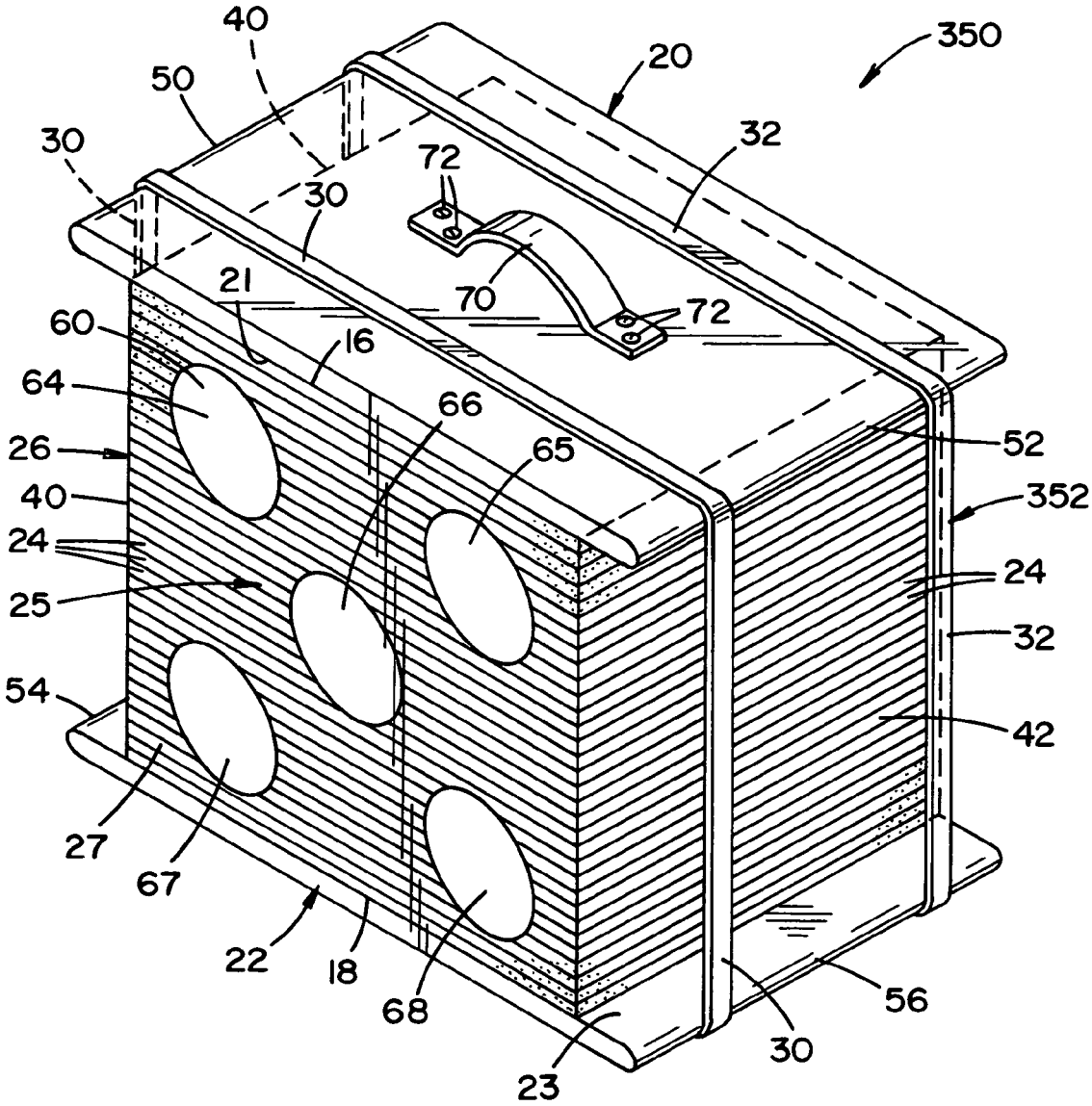

With reference to FIG. 10, shown is target 350, which includes a binder 352 that is further spaced from arrow receiving zone 25. As is discussed above, damage to arrows should be minimized. By spacing the binder from the target receiving zone, the likelihood of an arrow striking the binder is further reduced. More particularly, binder 352, which can include straps 30 and 32 discussed above, extends about edges 50, 52, 54 and 56 such that it is spaced from side edges 40 and 42. As with the other embodiments discussed above, the gap between the binder and the side edges can be filled by foam similar to layers 24 or by other material that will not damage the arrow if struck. While the spaced strap configuration is only shown in connection with one set of embodiments, it could be utilized with other embodiments discussed above.

As can be appreciated, the drawings of this application show generally cubic target structures. However, the target of this application can be produced in a wide variety of configuration without deviating from the invention of this application. Further, more than two sides of the target system can be used for the target indicia. This is especially true with the utilization of the corrugated outer structure, which allows more freedom relating the binder structure, or lack thereof, to allow the sides to also be used for targeting. Again, as is stated above, the drawings, are intended to be illustrative and not restrictive.

While considerable emphasis has been placed on the preferred embodiments of the invention illustrated and described herein, it will be appreciated that other embodiments can be made and that many changes can be made in the preferred embodiments, including equivalents thereof, without departing from the principles of the invention. Accordingly, it is to be distinctly understood that the foregoing descriptive matter is to be interpreted merely as illustrative of the invention and not as a limitation.

Having thus defined the invention, the following is claimed:

1. An archery target comprising a first and a second elongated support plate extending parallel to one another between a respective first and second plate ends, each said support plate having a support-plate length, inner surfaces facing one another and outer surfaces opposed to said inner surfaces, said each plate further including a strap opening; a plurality of elongated foam sheets extending parallel to one another to form a foam laminate having side surfaces parallel to said sheets and end surfaces transverse to said sheets, said side surfaces each facing one of said inner surfaces of said support plates and defining a foam laminate length that is shorter than said support-plate length, said foam laminate further including a front surface extending between said plates having an arrow receiving zone; and at least one compression strap extending about said outer surfaces of said plates and through said strap openings such that said strap is spaced from said first and second ends, said at least one strap urging said support plates toward said foam laminate and maintaining said support plates relative to said foam laminate.

2. The archery target of claim 1, wherein said compression strap engages at least a portion of said end surfaces of said foam laminate.

3. The archery target of claim 1, wherein said strap opening are a pair of holes in said support plate that are spaced from one another by an opening spacing that is generally equal to said length of said foam laminate, said compression strap engaging at least a portion of said end surfaces of said foam laminate.

4. The archery target of claim 1, wherein said foam sheets are made from closed cell foam.

5. The archery target of claim 1, further including an outer protective layer extending about said support plates and said foam laminate, said protective layer including a layer of corrugated plastic having at least one shooting opening thereby exposing a portion of said foam laminate.

6. The archery target of claim 1, wherein said target further includes a first and a second transverse sheet layer extending transverse to said plurality of elongated foam sheets, said first transverse sheet layer including a first sheet extending along one of said end surfaces of said foam laminate and said second transverse sheet layer including a second sheet extending along the other of said end surfaces.

7. The archery target of claim 6, further including an outer protective layer extending about said support plates and said foam laminate, said protective layer including a layer of corrugated plastic having at least one shooting opening thereby exposing said arrow receiving zone of said foam laminate.

8. The archery target of claim 6, wherein said first and second transverse sheet layers are foam sheets.

9. The archery target of claim 8, wherein said at least one compression strap extends between said foam laminate and said first sheet layer and between said foam laminate and said second sheet layer.

10. The archery target of claim 9, further including an outer protective layer extending about said support plates and said foam laminate, said protective layer including a layer of corrugated plastic having at least one shooting opening thereby exposing a portion of said foam laminate.

11. The archery target of claim 9, wherein said foam laminate and said first and second sheet layers together form a foam body having a length generally equal to said length of said support plates.

12. The archery target of claim 11, further including an outer protective layer extending about said support plates and said foam laminate, said protective layer including a layer of corrugated plastic having at least one shooting opening thereby exposing a portion of said foam laminate.

13. The archery target of claim 1, wherein said compression strap is two compression straps extending about said arrow receiving zone.

14. The archerytarget of claim 13, wherein said strap opening is a first and a second set of holes in each said support plate, said first and second sets of holes being spaced from one another by an opening spacing that is generally equal to said length of said foam laminate, said two compression straps engaging at least a portion of said end surfaces of said foam laminate.

15. The archery target of claim 1, wherein said strap opening of said each plate includes respectively a first opening extending inwardly from said first plate end and a second opening extending inwardly from said second plate end.

16. The archery target of claim 15, wherein said target further includes a first and a second transverse sheet layer extending transverse to said plurality of elongated foam sheets, said first transverse sheet layer including a first sheet extending along one of said end surfaces of said foam laminate and said second transverse sheet layer including a second sheet extending along the other of said end surfaces, said first and second transverse sheet layers engaging said one end surface and said other end surface respectively.

17. The archery target of claim 16, further including an outer protective layer extending about said support plates and said foam laminate.

18. The archery target of claim 16, wherein said foam laminate and said first and second sheet layers together form a foam body having a length generally equal to said length of said support plates.

19. The archery target of claim 16, wherein said at least one compression strap extends between said foam laminate and said first sheet layer and between said foam laminate and said second sheet layer.

20. An archery target comprising an elongated support plate extending between a first and second plate end, said support plate having a support-plate length, an inner surface and an outer surface opposed to said inner surface, said support plate further including a strap opening; a plurality of elongated foam sheets extending parallel to one another to form a foam laminate having side surfaces parallel to said sheets and end surfaces transverse to said sheets, one of said side surfaces facing said inner surface of said support plate and defining a foam laminate length that is shorter than said support-plate length, said foam laminate further including a front surface extending between said side surfaces of said foam laminate having an arrow receiving zone; and at least one compression strap extending about said outer surface of said support plate and through said strap openings such that said strap is spaced from said first and second ends, said at least one strap urging said support plate toward said foam laminate and maintaining said support plate relative to said foam laminate, said support plate is a bottom support plate, said target further including a top support plate, said top support plate having, an inner surface and an outer surface opposed to said top plate inner surface, said top support plate inner surface facing the other of said one said side surfaces.

21. The archery target of claim 20, wherein said foam sheets are made from closed cell foam.

22. The archery target of claim 6, further including an outer protective layer extending about said support plate and said foam laminate, said protective layer including a layer of corrugated plastic having at least one shooting opening thereby exposing said arrow receiving zone of said foam laminate.

23. The archery target of claim 20, wherein said strap opening includes a first opening extending inwardly from said first plate end and a second opening extending inwardly from said second plate end.

* * * * *